US007734203B2

(12) United States Patent
Tanaka

(10) Patent No.: US 7,734,203 B2
(45) Date of Patent: Jun. 8, 2010

(54) IMAGE FORMATION APPARATUS, AN IMAGE FORMATION PROCESS CONTROL METHOD, AND A RECORDING MEDIUM

(75) Inventor: Hideo Tanaka, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 283 days.

(21) Appl. No.: 12/035,111

(22) Filed: Feb. 21, 2008

(65) Prior Publication Data

US 2008/0232830 A1 Sep. 25, 2008

(30) Foreign Application Priority Data

Mar. 19, 2007 (JP) ..... 2007-071371

(51) Int. Cl.
*G03G 15/00* (2006.01)
*G03G 15/08* (2006.01)
*G03G 15/06* (2006.01)

(52) U.S. Cl. ..... 399/49; 399/30; 399/55

(58) Field of Classification Search ..... 399/27, 399/30, 35, 49, 61, 55
See application file for complete search history.

(56) References Cited

U.S. PATENT DOCUMENTS 5,581,221 A * 12/1996 Kawai et al. ..... 399/49
6,553,191 B1 * 4/2003 Nakane ..... 399/49 X
6,853,817 B2 * 2/2005 Suzuki ..... 399/49
2007/0071477 A1 3/2007 Tanaka

FOREIGN PATENT DOCUMENTS

| | | |
|---|---|---|
| JP | 11-65259 | 3/1999 |
| JP | 2001-109204 | 4/2001 |
| JP | 2002-258596 | 9/2002 |
| JP | 2002-341640 | 11/2002 |
| JP | 2004-354666 | 12/2004 |

* cited by examiner

*Primary Examiner*—Sandra L Brase
(74) *Attorney, Agent, or Firm*—Oblon, Spivak, McClelland, Maier & Neustadt, L.L.P.

(57) ABSTRACT

An image formation apparatus including a toner cartridge for holding toner, an image supporting unit, on which an electrostatic latent image corresponding to a toner image is formed, a toner development unit for developing the latent image into the toner image with the toner, a detecting unit for detecting toner concentration of the toner image, and a control unit for controlling an amount of toner adhering to the latent image by adjusting a development bias voltage based on an output of the detecting unit. If control by the control unit based on the detection output of the detecting unit is insufficient, and consumption of the toner is out of a predetermined normal range, the control is carried out by estimating one of toner consumption amount and toner recovery amount in a direction that departs from the predetermined normal range.

13 Claims, 13 Drawing Sheets

IMAGE FORMATION APPARATUS, AN IMAGE FORMATION PROCESS CONTROL METHOD, AND A RECORDING MEDIUM

BACKGROUND OF THE INVENTION

1. Field of the Invention

The present invention generally relates to an image formation apparatus, an image formation process control method, and a recording medium; and especially relates to an image formation apparatus that detects toner concentration using a toner concentration detection sensor, a control method of controlling an image formation process of the image formation apparatus, and a recording medium for storing a computer program for a computer to read and execute for carrying out the control method.

2. Description of the Related Art

[Background Technique]

As image formation apparatuses and image formation process control methods of this kind, disclosures have been made by, e.g., Patent References 1 and 2. Patent Reference 1 attempts to acquire proper detection of "toner end" (a status where there is no more toner available) by avoiding incorrect detection of "toner end" by a toner concentration sensor formed at the bottom of a development unit. According to Patent Reference 1, "toner end" is started to be detected by the toner concentration sensor when an accumulated toner supply time (that corresponds to an accumulated consumption amount of the toner) of the toner sent to the development unit reaches a predetermined value, wherein the predetermined value is defined by an estimated minimum accumulated time from the first use of a toner bottle (cartridge) to "toner end". There, the predetermined value is stored in a nonvolatile storage that is arranged at the bottle in one body. Further, every time image formation is carried out, the accumulated toner supply time is updated and stored for each toner bottle. In this way, the start time of detecting "toner end" is properly determined.

According to Patent Reference 2, no special sensors are used, but a period during which the toner is actually consumed is used as representing toner consumption from the toner bottle. Here, in an attempt to reduce estimating errors with reference to actual toner consumption, a nonvolatile storage is provided on the toner bottle for storing information on the quantity of toner consumed from the toner bottle. The nonvolatile storage is exposed on the top face of the toner bottle, and is connected to a control unit of the main body of the image formation apparatus through a contact terminal on a fixing member of the toner bottle. There, the residual quantity of the toner in the toner bottle is calculated based on the toner bottle capacity, a supply capacity (for example, 0.5 g/s) of a powder pump for toner supplied from the bottle, and toner supply time. In this way, the error with reference to actual toner consumption is minimized.

[Patent Reference 1] JPA 2002-258596

[Patent reference 2] JPA 2002-341640

DISCLOSURE OF INVENTION

Objective of Invention

As described, according to Patent Reference 1, "toner end" is detected by the toner concentration sensor; and according to Patent Reference 2, "toner end" is identified without using a toner concentration sensor. In image formation apparatuses where no residual toner quantity detection sensor is provided in the toner bottle like the latter case, "toner end" and "toner near end" conditions are identified by calculating a toner residual quantity in the toner bottle by estimating the consumption amount. However, the estimate is based on an assumed normal toner consumption amount. That is, if a photoconductor is poorly charged, the toner consumption amount may be greater than normal, which results in a situation wherein the toner actually runs short before "toner end" is identified, and a poor image is formed. Further, if the photoconductor is poorly exposed, toner consumption can be less than normal, which results in a situation wherein "toner end" is identified, and the image formation apparatus may stop operations even if toner remains.

In either case, when a fault occurs in voltage adjustment (bias voltage) of a development unit, and the amount of toner adhered fluctuates with reference to an amount estimated based on a characteristic adhesion amount of the toner obtained in a process of adjusting the voltage, the toner consumption amount fluctuates, leading to an incorrect identification of "toner end" and image quality is degraded.

SUMMARY OF THE INVENTION

Accordingly, the present invention provides an image formation apparatus, an image formation process control method, and a recording medium that substantially obviate one or more of the problems caused by the limitations and disadvantages of the related art, wherein the image formation apparatus is capable of producing a high-quality image even if a fault occurs in voltage adjustment of the development bias voltage.

Features of embodiments of the present invention are set forth in the description that follows, and in part will become apparent from the description and the accompanying drawings, or may be learned by practice of the invention according to the teachings provided in the description. Problem solutions provided by an embodiment of the present invention may be realized and attained by an image formation apparatus, an image formation process control method, and a recording medium particularly pointed out in the specification in such full, clear, concise, and exact terms as to enable a person having ordinary skill in the art to practice the invention.

To achieve these solutions and in accordance with an aspect of the invention, as embodied and broadly described herein, an embodiment of the invention provides an image formation apparatus, an image formation process control method, and a recording medium as follows.

According to an aspect of the embodiment, the image formation apparatus includes a toner cartridge for holding toner, an image supporting unit, on which an electrostatic latent image corresponding to a toner image is formed, a toner development unit for developing the latent image into a toner image with the toner, a detecting unit for detecting toner concentration of the toner image, and a control unit for controlling an amount of toner adhered to the latent image by adjusting a development bias voltage based on an output of the detecting unit. Here, if control by the control unit based on the detection output of the detecting unit is insufficient, and consumption of the toner is out of a predetermined normal range, the control is carried out by estimating one of consumption amount and recovery amount in a direction that departs from the normal range.

According to another aspect of the embodiment, the image formation apparatus includes only one image supporting unit, and the detecting unit detects toner concentration of a monochrome toner image.

According to another aspect of the embodiment, the image formation apparatus includes two or more image supporting units, and the detecting unit detects the toner concentration of a toner image transferred to a middle transfer medium from the image supporting units, wherein the toner image is in two or more corresponding colors.

According to another aspect of the embodiment, if the toner consumption amount is greater than the normal range, the control unit controls by increasing the estimated toner consumption amount.

According to another aspect of the embodiment, if the toner consumption amount is less than the normal range, the control unit controls by decreasing the estimated toner consumption amount.

According to another aspect of the embodiment, if the toner consumption amount is greater than the normal range, the control unit controls by increasing the estimated toner consumption amount considering a difference from the normal range.

According to another aspect of the embodiment, if the toner consumption amount is less than the normal range, the control unit controls by decreasing the estimated toner consumption amount considering a difference from the normal range.

According to another aspect of the embodiment, if the toner consumption amount is greater than the normal range, the control unit controls by increasing estimated amounts of toner recovery amount in the toner cartridge and disposed toner recovery amount of the image formation apparatus as a whole.

According to another aspect of the embodiment, if the toner consumption amount is less than the normal range, the control unit controls by decreasing estimated amounts of toner recovery in the toner cartridge and disposed toner recovery of the image formation apparatus as a whole.

According to another aspect of the embodiment, if the toner consumption amount is greater than the normal range, the control unit controls by increasing the estimated amounts of toner recover in the toner cartridge and disposed toner recovery of the image formation apparatus as a whole considering a difference from the normal range.

According to another aspect of the embodiment, if the toner consumption amount is less than the normal range, the control unit controls by decreasing the estimated amounts of toner recovery in the toner cartridge and disposed toner recovery of the image formation apparatus as a whole considering a difference from the normal range.

Another aspect of the embodiment provides a control method of the image formation apparatus as described above.

Another aspect of the embodiment provides a computer-readable recording medium for storing a computer-executable program for a computer to realize the control method of the image formation apparatus as described above.

Here, the image supporting body corresponds to photoconductors (1-*a*, 1-*b*, 1-*c*, and 1-*d*), the middle transfer medium corresponds to a middle transfer belt (2), the detecting unit corresponds to a sensor (4), the control unit corresponds to a control unit (18) including a CPU (6) in the embodiment described below.

Effectiveness of Invention

According to the present invention, image formation can be normally performed without degrading image quality and without interruption of image formation even if a fault arises in adjustment of the development bias voltage.

DESCRIPTION OF THE PREFERRED EMBODIMENTS

In the following, embodiments of the present invention are described with reference to the accompanying drawings.

Figure 1:
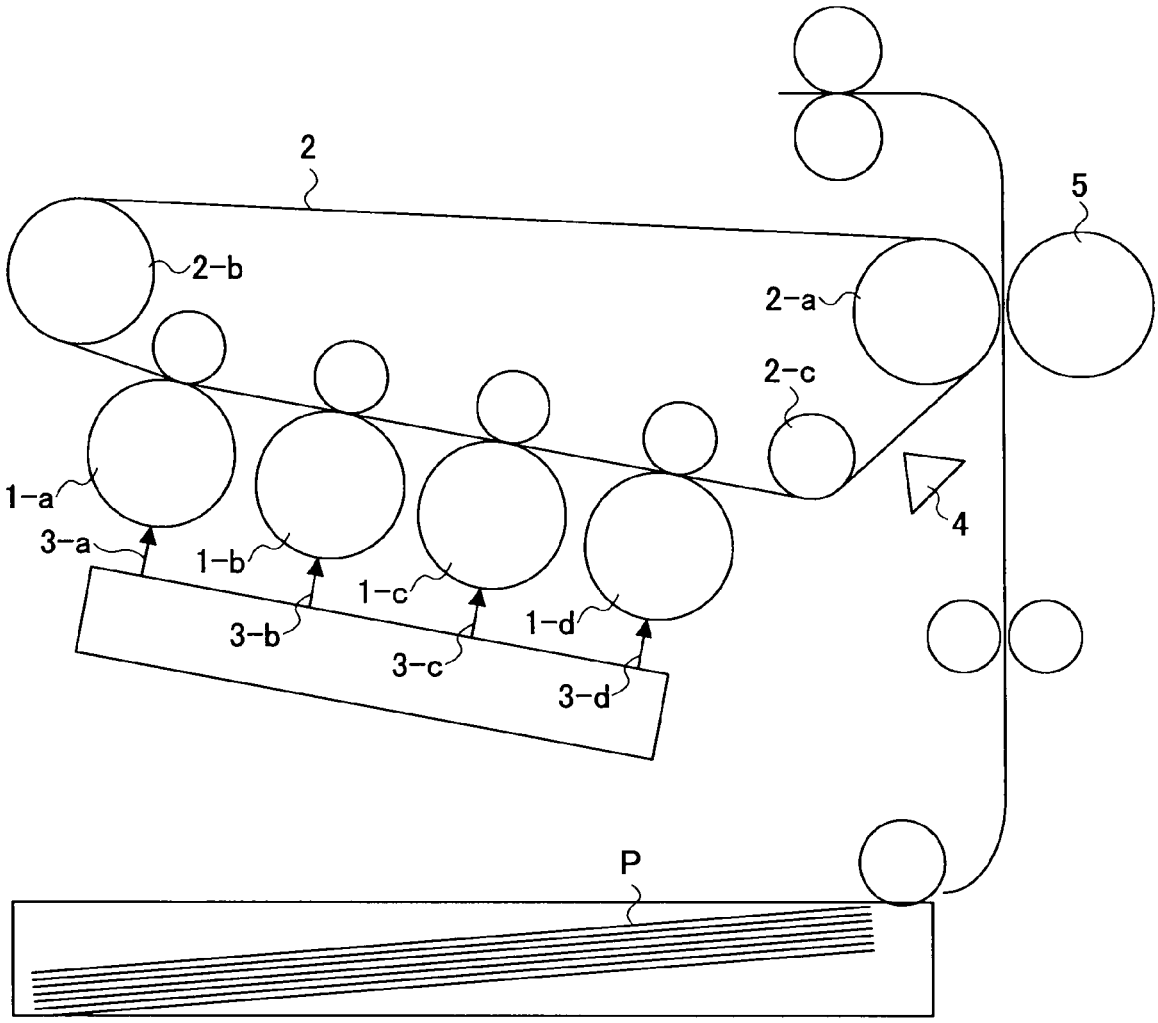
FIG. 1 is a schematic drawing showing the configuration of the principal part of an image formation apparatus according to an embodiment of the present invention.

As shown in FIG. 1, an image formation apparatus according to the embodiments of the present invention includes four photoconductors 1-*a*, 1-*b*, 1-*c*, and 1-*d*, a middle transfer belt 2 that is in contact with the photoconductors 1-*a*, 1-*b*, 1-*c*, and 1-*d*, LD units 3-*a*, 3-*b*, 3-*c*, and 3-*d* for irradiating LD lights of corresponding colors onto the photoconductors 1-*a*, 1-*b*, 1-*c*, and 1-*d*, respectively, and a sensor 4 for reading concentration of a toner image formed on the middle transfer belt 2.

Although not illustrated, the image formation apparatus further includes toner cartridges and toner development units provided around the perimeter part of the photoconductors 1-*a*, 1-*b*, 1-*c*, and 1-*d*. The toner cartridges are attached to toner tanks of the toner development units.

The photoconductors 1-*a*, 1-*b*, 1-*c*, and 1-*d* are made in the shape of a drum, and are used for forming images in Y (yellow), M (magenta), C (cyan), and K (black) colors, respectively. The middle transfer belt 2 is in contact with the photoconductors 1-*a*, 1-*b*, 1-*c*, and 1-*d*. Toner images in the colors formed on the corresponding photoconductors 1-*a*, 1-*b*, 1-*c*, and 1-*d* are transferred onto the middle transfer belt 2 with corresponding primary transfer rollers arranged on the opposite side of the middle transfer belt 2. The middle transfer belt 2 is wound with tension around a drive roller 2-*a*, a backup roller 2-*b*, and a tension roller 2-*c*. A secondary transfer roller 5 functioning as a transfer backup roller is arranged at a position countering the drive roller 2-*a*. Paper P is fed from a paper feed tray, is led to a nip constituted by the drive roller 2-*a* and the secondary transfer roller 5 by a conveyance roller pair. At the nip, a full-color image formed by superposing the toner images in four colors on the middle transfer belt 2 is transferred to the paper P. Then, the image transferred to the paper P is fixed by a downstream fixing unit and the paper P is discharged from the image formation apparatus.

Figure 2:
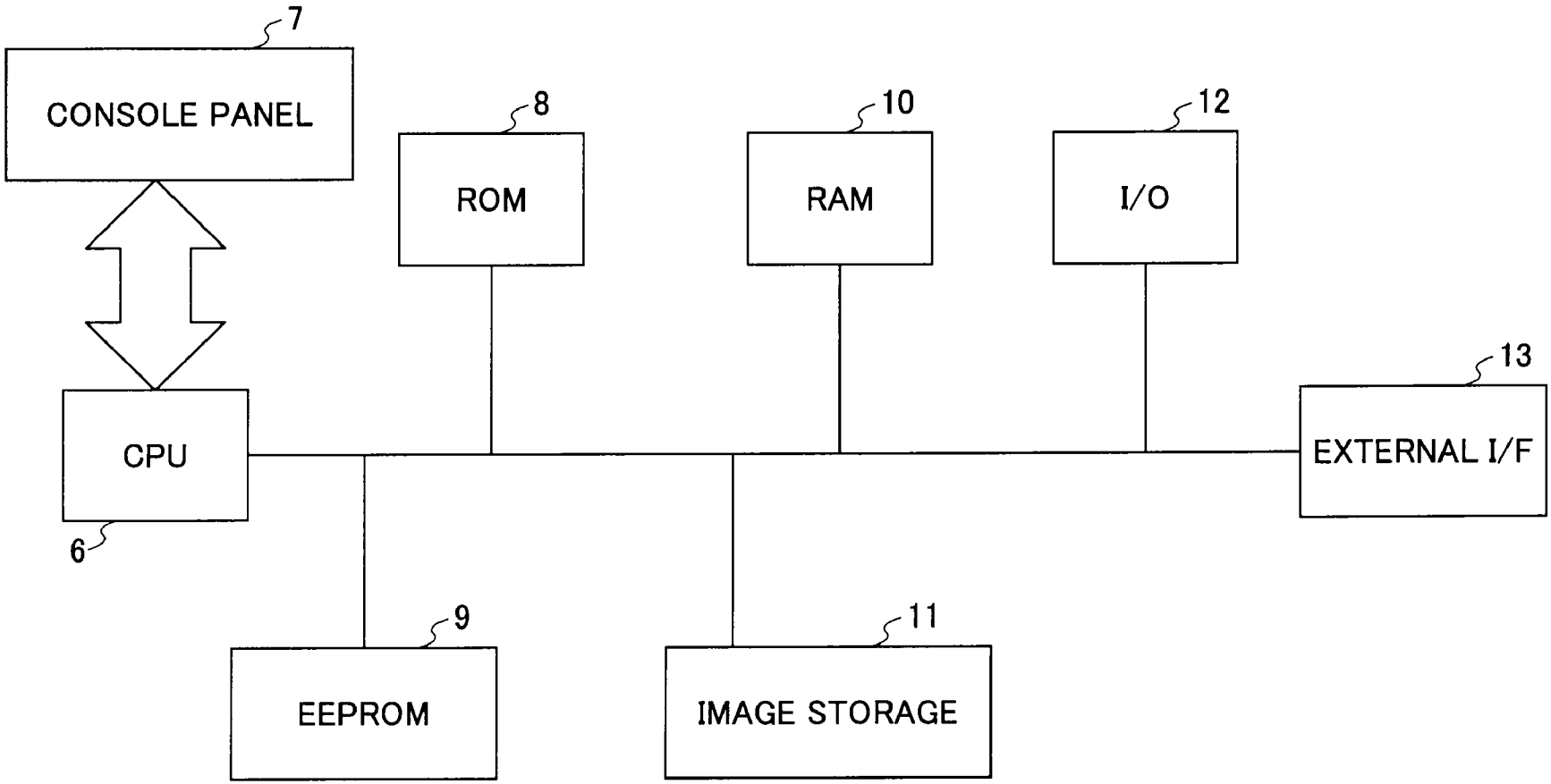
FIG. 2 is a block diagram showing a system assembly of the image formation apparatus according to the embodiment.

FIG. 2 is a block diagram showing a system assembly of the image formation apparatus according to the embodiment of the present invention. The image formation apparatus includes a CPU 6, a ROM 8, an EEPROM 9, a RAM 10, an image storage 11, an I/O 12, and an external I/F 13 as shown in FIG. 2. Further, a console panel 7 is connected to the CPU 6.

The CPU 6 interprets and executes program commands for controlling the image formation apparatus and its various functional units. The console panel 7 is for a user of the image formation apparatus to view the status of the image formation apparatus and to operate the image formation apparatus. The ROM 8 is a semiconductor read-only memory for storing a program that the CPU 6 executes. Contents of the EEPROM 9 can be electrically erased (or overwritten), and the contents are held even if a power source is shut off. The RAM 10 is a semi-conductor memory that is capable of reading and writing specifying a desired address. The image storage 11 is for storing data for the image formation apparatus to print. The I/O 12 controls input/output of units such as a sensor, a motor, and a clutch. The external I/F 13 provides an interface between the image formation apparatus and a terminal that requests the image formation apparatus to print.

Figure 3:
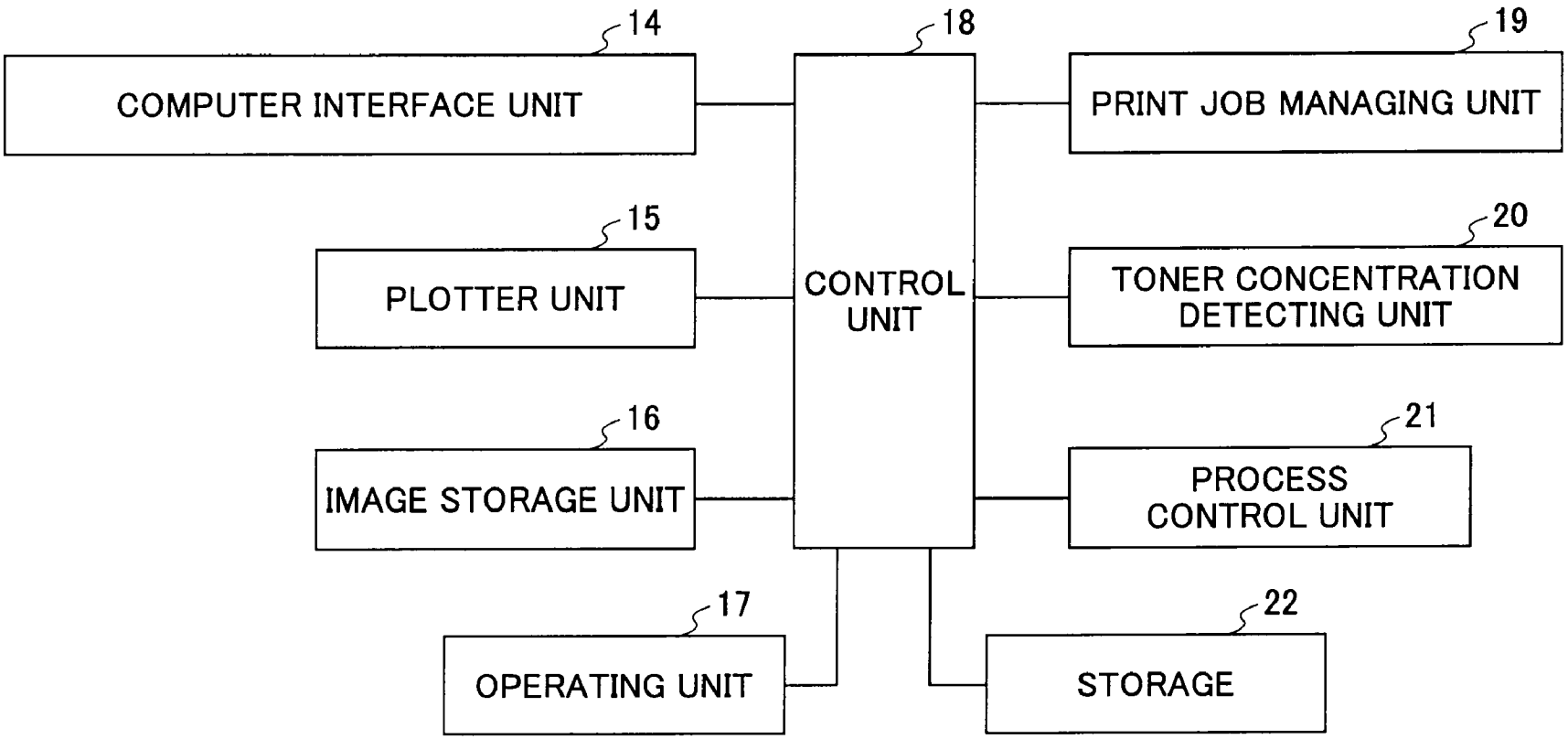
FIG. 3 is a block diagram of the image formation apparatus according to the embodiment.

FIG. 3 is a block diagram of the image formation apparatus according to the embodiment. The image formation apparatus includes a computer interface unit 14, a plotter unit 15, an image storage unit 16, an operating unit 17, a control unit 18, a print job managing unit 19, a toner concentration detecting unit 20, a process control unit 21, and a storage 22.

The computer interface unit 14 is for communicating with a terminal that requests printing by the image formation apparatus. The plotter unit 15 is for generating a toner image of an image stored in the image storage unit 16 by electrophotography, for transferring the toner image onto the paper P, and for discharging the paper P outside the image formation apparatus. The image storage unit 16 is for storing image data provided to the image formation apparatus by the terminal that requests printing. The operating unit 17 is for displaying a status of the image formation apparatus, and for receiving an input to the image formation apparatus. The console panel 7 is a user interface of the operating unit 17. The print job managing unit 19 is for managing execution priorities of printing jobs requested to be performed by the image formation apparatus. The toner concentration detecting unit 20 is for detecting toner concentration of a toner image on the middle transfer belt 2. The process control unit 21 is for adjusting the toner concentration by adjusting a development bias voltage. The storage 22 is for storing data such as a toner consumption amount, a toner recovery amount (of each cartridge, and the image formation apparatus as a whole), a "toner end" amount, and a disposed toner amount (of each cartridge, and the image formation apparatus as a whole). The control unit 18 controls operations of the functional units described above, wherein the units are connected to the control unit 18. According to the embodiment, the system assembly shown in FIG. 2 including the CPU 6 is arranged in the control unit 18.

Figure 4:
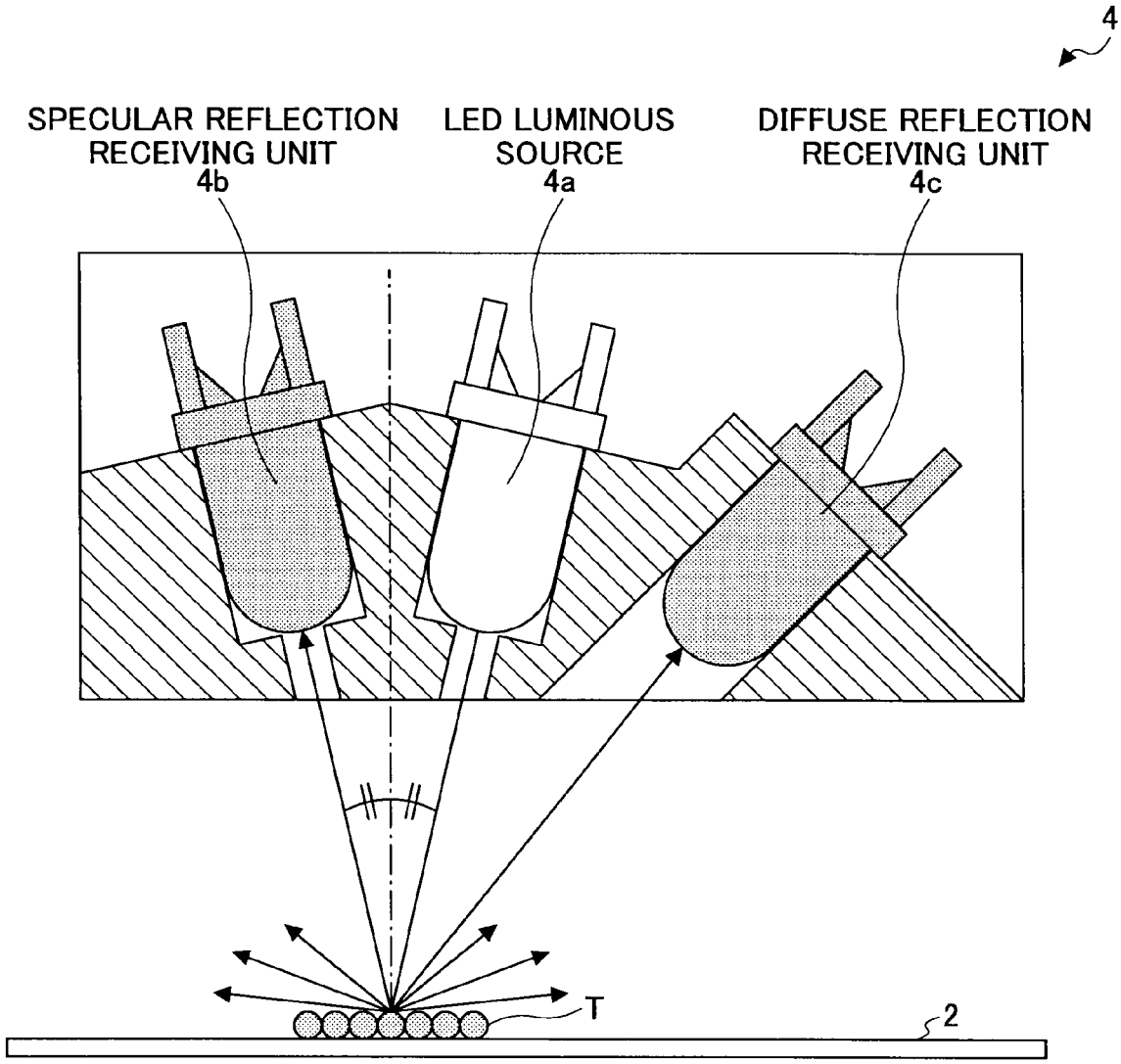
FIG. 4 is a schematic drawing showing the internal configuration of a sensor.

FIG. 4 shows the internal configuration of the sensor 4, which is a so-called toner mark (concentration) sensor. The sensor 4 includes an LED luminous source 4*a*, a specular reflection receiving unit 4*b*, and a diffuse reflection receiving unit 4*c*. The LED luminous source 4*a* irradiates a light to the middle transfer belt 2, and the light is reflected by the middle transfer belt 2. The specular reflection receiving unit 4*b* is for detecting a specular reflection light and for generating a voltage based on the detection. Although FIG. 4 shows the diffuse reflection receiving unit 4*b*, this unit is not directly concerned with the embodiment; accordingly, detailed descriptions are omitted.

When the plotter unit 15 of the image formation apparatus forms a toner image and transfers the toner image onto the paper, the toner concentration of the toner image transferred onto the paper tends to vary due to degradation of components and environmental changes (temperature and humidity). For this reason, the process control unit 21 carries out an operation of adjusting the toner concentration based on the number of toner images generated and a timing of the environmental change. According to an example of the adjustment operation of the toner concentration, a fixed charging bias is applied to the photoconductors 1-*a*, 1-*b*, 1-*c*, and 1-*d*, and exposure of a fixed amount is carried out by the LD units 3-*a*, 3-*b*, 3-*c*, and 3-*d*, respectively. At this time, the development bias voltage of the toner cartridges corresponding to the photoconductors 1-*a*, 1-*b*, 1-*c*, and 1-*d* is made variable, and toner images are formed. The formed and superposed full-color toner image is read by the sensor 4.

Figure 5:
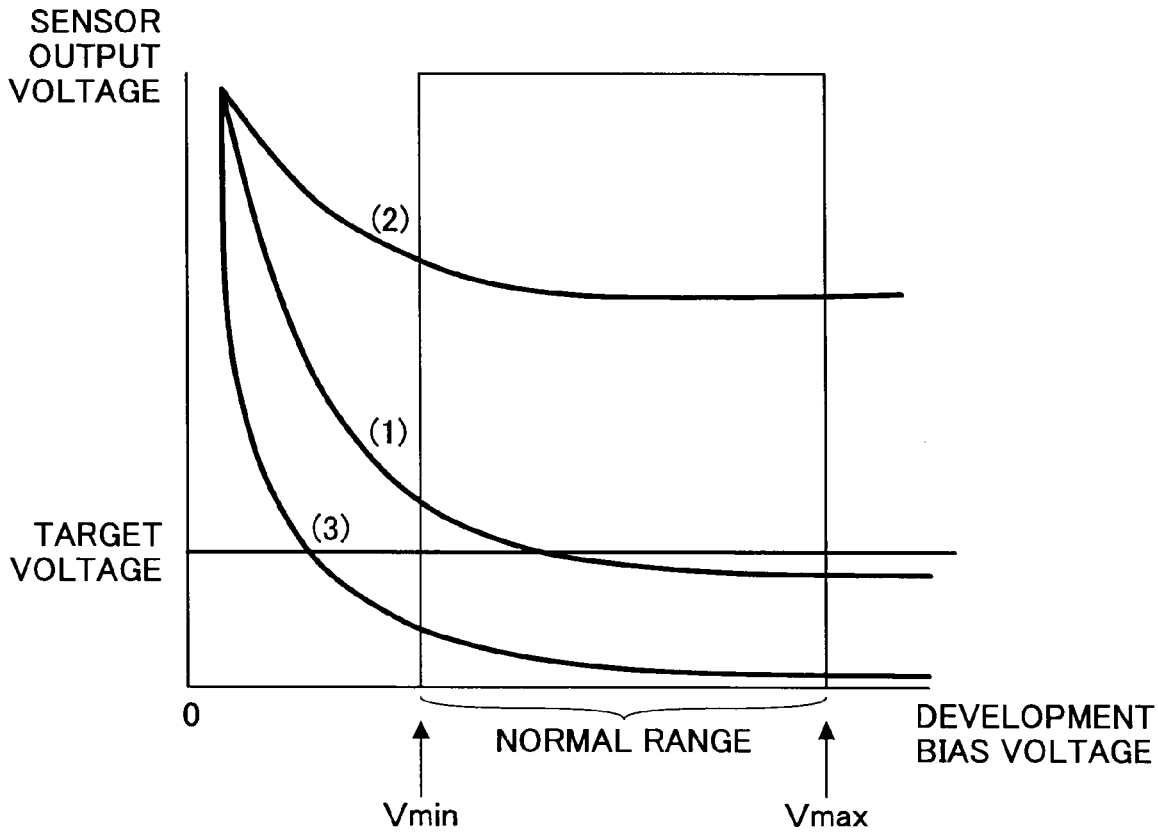
FIG. 5 is a graph showing relationships between a development bias voltage and a sensor output voltage.

Relationships between the development bias voltage and an output voltage of the sensor 4 (sensor output voltage) are shown in FIG. 5. The sensor output voltage can be converted into toner concentration, wherein the less is the sensor output voltage, the greater is the toner concentration. In the toner concentration adjustment operation carried out by the process control unit 21, data such as shown in FIG. 5 are acquired, and a development bias voltage that results in a target toner concentration (a target voltage in FIG. 5) is calculated referring to the acquired data. The calculated development bias voltage is used by the plotter unit 15 to generate a toner image at a stable concentration.

With reference to FIG. 5, a normal range of the development bias voltage is defined, wherein the normal range is delimited by a smallest bias voltage Vmin (on the left hand side in FIG. 5) and a greatest bias voltage Vmax (on the right hand side in FIG. 5).

Where the toner cartridge of the image formation apparatus does not include a residual toner quantity detection sensor, it is assumed that toner images are always generated at a constant target toner concentration; the control unit 18 estimates the consumption amount of the toner (consumed by generating the toner image); adds the estimated consumption amount to the toner consumption amount stored in the storage 22; and the added result is compared with the "toner end" amount stored in the storage 22. If it is determined by the comparison that the added result exceeds the "toner end" amount, a message about "toner end" is displayed on the operating unit 17.

Further, amounts of toner recovered (toner recovery amounts) in the disposed toner box of the toner cartridge and the disposed toner box of the image formation apparatus as a whole are estimated based on the estimated toner consumption; the estimated recovery amounts are added to corresponding toner recovery amounts stored in the storage 22; the added results are compared with corresponding disposed toner amounts stored in the storage 22; if one of the added toner recovery amounts exceeds a corresponding disposed toner amount, the fact "disposed toner box full") is displayed on the operating unit 17.

Hereafter, Examples of toner concentration adjustment operations are described with reference to the relationships between the development bias voltage and the sensor output voltage as shown in FIG. 5. A curve associated with (1) represents a target characteristic. Acquired data may be one of curves associated with (2) and (3). The adjustment operations are for acquiring a development bias voltage that gives "Target Voltage" of the sensor output voltage.

Example 1

Example 1 is the case wherein the acquired data are such as shown by (3) i.e., less than the target characteristic (1), the development bias voltage is made equal to a bias voltage at the latest successful toner concentration adjustment operation, and the greatest toner consumption amount (toner concentration corresponding to 0 V of the sensor output voltage with reference to FIG. 5) is used for calculating the toner consumption.

Figure 6:
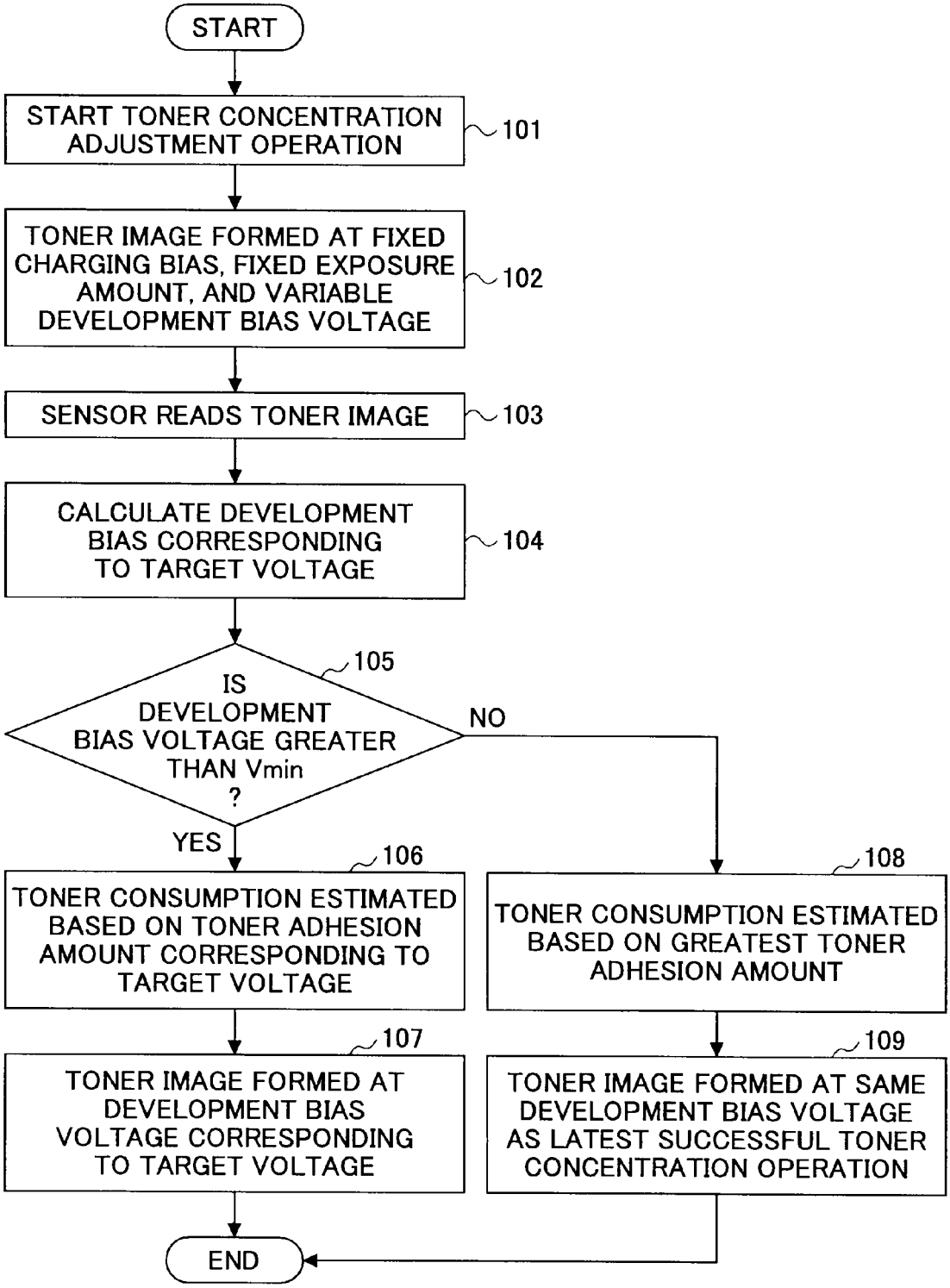
FIG. 6 is a flowchart showing operations sequence according to Example 1.

The operation of Example 1 is described with reference to a flowchart of FIG. 6. The toner concentration adjustment operation is started (step 101). Then, a toner image is formed at a fixed charging bias voltage, a fixed exposure amount, and a variable development bias voltage (step 102). Then, the toner image is read by the sensor 4 to generate a sensor output voltage (step 103). A development bias voltage corresponding to the target voltage is calculated based on the sensor output voltage (step 104). Then, the calculated development bias voltage is compared with the smallest bias voltage Vmin for development (step 105).

If the calculated development bias voltage is equal to or greater than the smallest bias voltage Vmin, the calculated development bias voltage is regarded to fall within the normal range, toner consumption is estimated based on an amount of toner adhesion corresponding to the target voltage (step 106), and a toner image is formed at a development bias voltage corresponding to the target voltage (step 107). If the calculated development bias voltage is less than the smallest bias voltage, the calculated development bias voltage is outside the normal range, toner consumption is estimated based on the maximum toner adhesion amount (step 108), and a toner image is formed at the same development bias voltage as the latest successful toner concentration adjustment operation (step 109).

As described above, according to Example 1, if it is determined through the voltage adjustment of the development unit that the toner consumption amount is greater than a predetermined toner consumption amount (No at step 105), the toner consumption amount is estimated at an amount greater than the predetermined toner consumption amount (step 108). In this way, an image deficit {(degraded printing)} before "toner end" is prevented.

Example 2

Example 2 is the case wherein the acquired data are such as shown by (2), i.e., greater than the target characteristic (1), the development bias voltage is set to the same bias voltage as the latest successful toner concentration adjustment operation, and the smallest toner consumption amount (toner concentration corresponding to the lowest sensor output voltage out of acquired data) is used for calculating the toner consumption.

Figure 7:
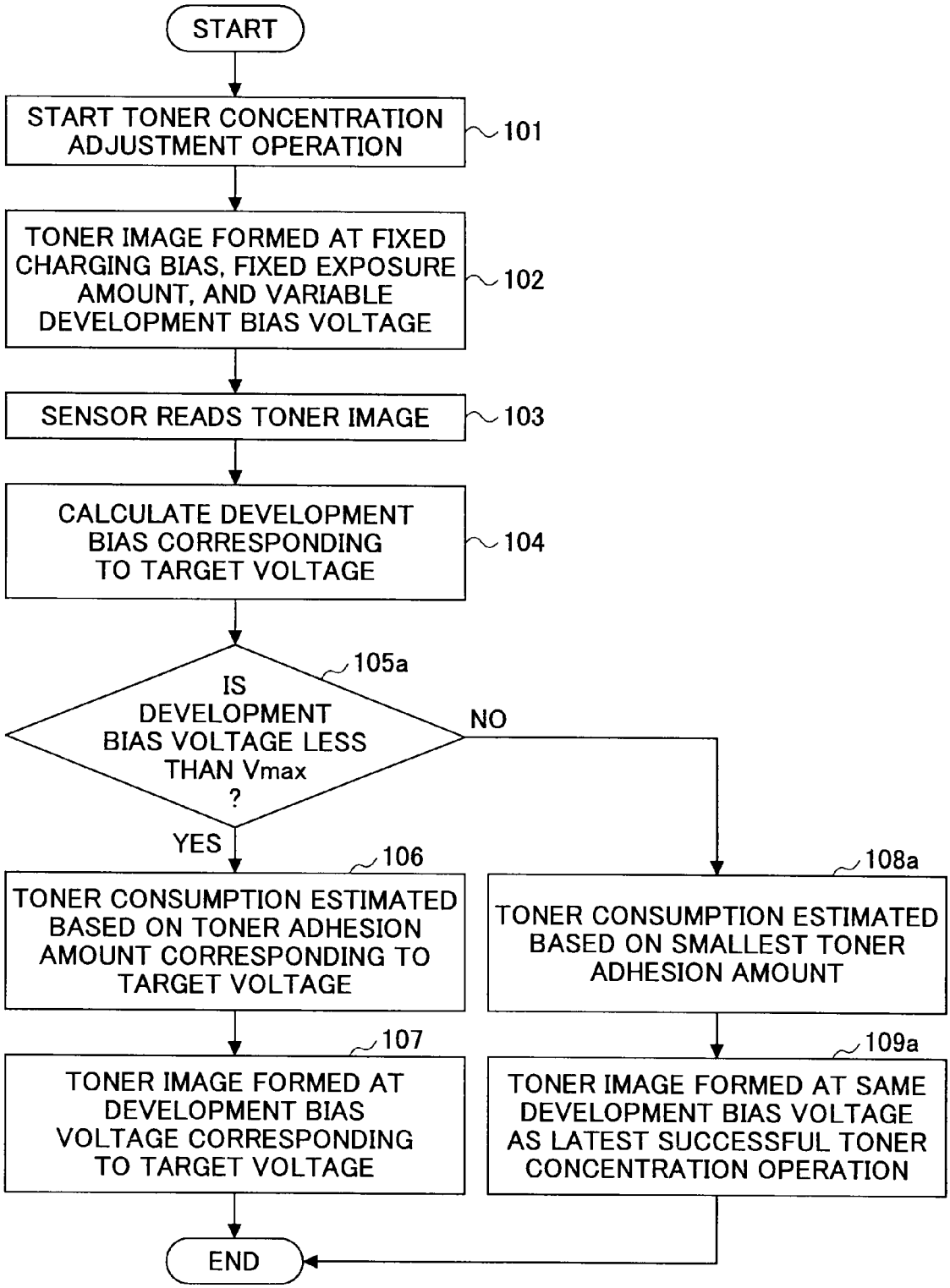
FIG. 7 is a flowchart showing operations sequence according to Example 2.

FIG. 7 is a flowchart of operations according to Example 2. Here, the steps 101 through 104 are the same as Example 1; then at step 105*a*, the calculated development bias voltage is compared with the greatest bias voltage Vmax.

If the calculated development bias voltage is equal to or less than the greatest bias voltage Vmax, the calculated development bias voltage is considered normal, toner consumption is estimated based on the amount of toner adhesion corresponding to the target voltage (step 106), and a toner image is formed at a development bias voltage corresponding to the target voltage (step 107). If the calculated development bias voltage is greater than the greatest bias voltage Vmax, the calculated development bias voltage is considered outside of the normal range, toner consumption is estimated based on the minimum amount of toner adhesion (step 108*a*), and a toner image is formed at the same development bias voltage as the latest successful toner concentration adjustment operation (step 109*a*).

As described, according to Example 2, if it is determined through the voltage adjustment of the development unit that the toner consumption amount is less than the predetermined toner consumption amount (No at step 105*a*), the toner consumption amount is estimated at an amount less than the predetermined toner consumption amount (step 108*a*). In this way, "toner end" while there is much toner left available is prevented.

Example 3

Example 3 is the case wherein the acquired data are such as shown by (3), i.e., less than the target characteristic (1), the development bias voltage is made equal to the smallest bias voltage Vmin, and a toner consumption amount corresponding to the smallest bias voltage Vmin is used for calculating the toner consumption.

Figure 8:
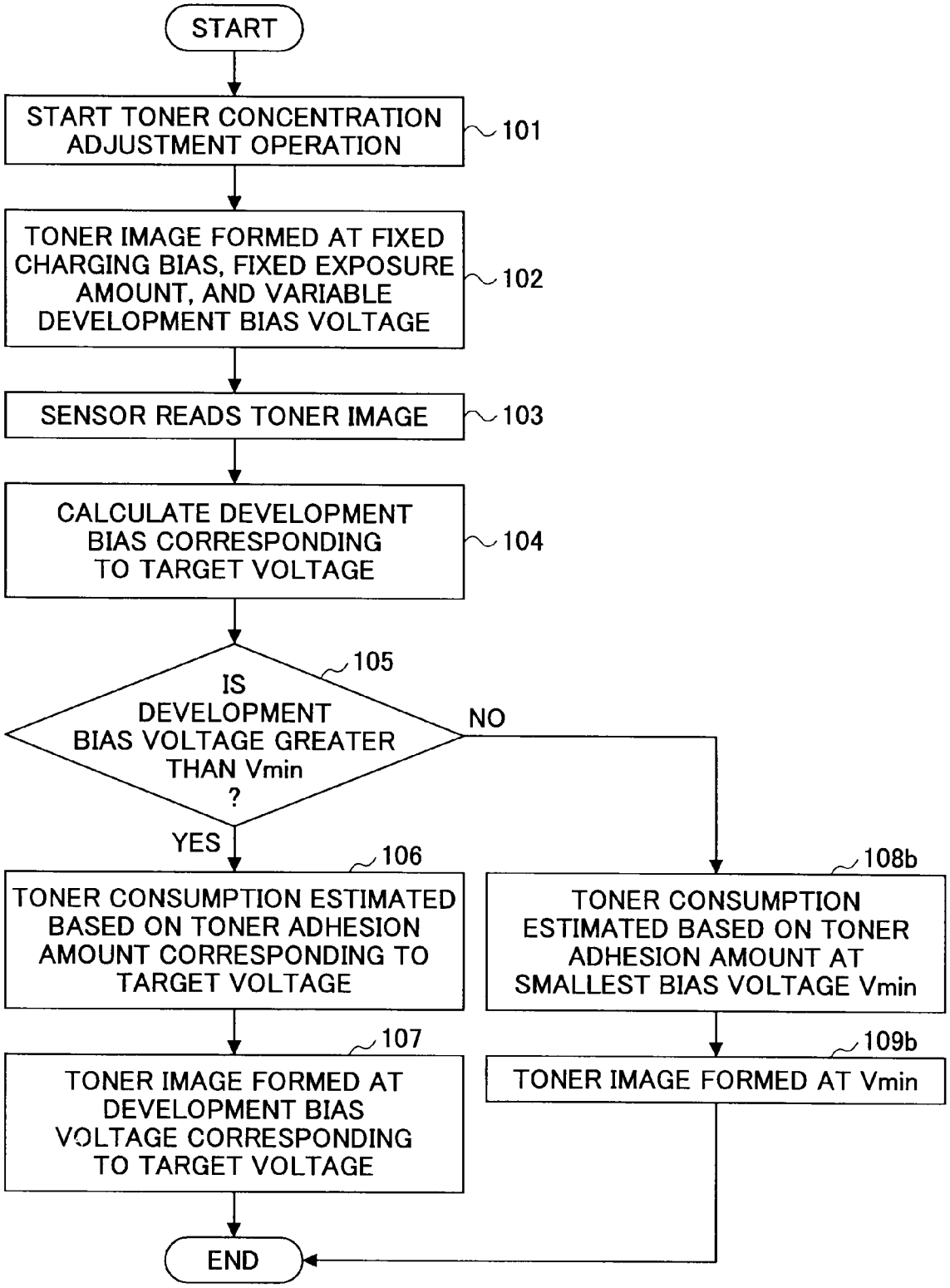
FIG. 8 is a flowchart showing operations sequence according to Example 3.

FIG. 8 is a flowchart of operations according to Example 3. Here, the steps 101 through 105 are the same as Example 1. At the step 105, if the calculated development bias voltage is equal to or greater than the smallest bias voltage Vmin, the calculated development bias voltage is within the normal range, and toner consumption is estimated based on the amount of toner adhesion corresponding to the target voltage (step 106), and a toner image is formed at the development bias voltage corresponding to the target voltage (step 107). Otherwise, toner consumption is estimated based on the amount of toner adhesion corresponding to the smallest bias voltage Vmin (step 108*b*), and a toner image is formed at the smallest bias voltage Vmin (step 109*b*).

As described, according to Example 3, if it is determined through the voltage adjustment of the development unit that the toner consumption amount is greater than the predetermined toner consumption amount (No at step 105*a*), the toner consumption amount is estimated considering a toner adhesion characteristic obtained in the process of voltage adjustment (step 108*b*). In this way, accuracy of "toner end" is improved.

Example 4

Example 4 is the case wherein the acquired data are such as shown by (2), i.e., greater than the target characteristic (1), the development bias voltage is set at the greatest bias voltage Vmax, and a toner consumption amount corresponding to the greatest bias voltage Vmax is used for calculating the toner consumption.

Figure 9:
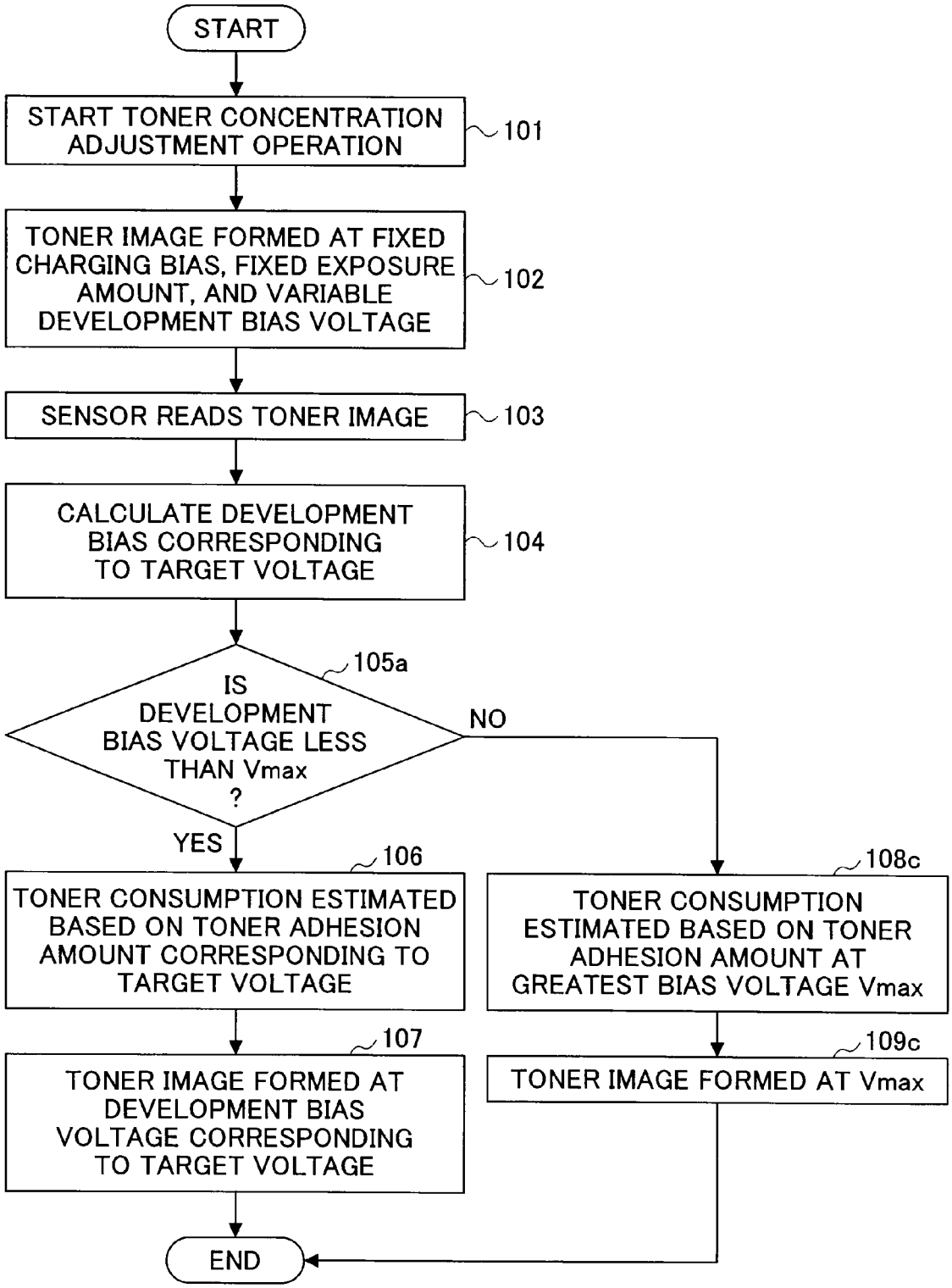
FIG. 9 is a flowchart showing operations sequence according to Example 4.

FIG. 9 is a flowchart of operations according to Example 4. Here, the steps 101 through 104 are the same as Example 1; then at step 105*a*, the calculated development bias voltage is compared with the greatest bias voltage Vmax.

If the calculated development bias voltage is equal to or less than the greatest bias voltage Vmax, the calculated development bias voltage is considered normal, toner consumption is estimated based on the amount of toner adhesion corresponding to the target voltage (step 106), and a toner image is formed at a development bias voltage corresponding to the target voltage (step 107). If the calculated development bias voltage is greater than the greatest bias voltage Vmax, the calculated development bias voltage is considered outside of the normal range, toner consumption is estimated based on a toner adhesion amount corresponding to the greatest bias voltage Vmax (step 108*c*), and a toner image is formed at the greatest bias voltage Vmax (step 109*c*).

As described, according to Example 4, if it is determined through the voltage adjustment of the development unit that the toner consumption amount is less than the predetermined toner consumption amount (No at step 105*a*), the toner consumption amount is estimated considering the toner adhesion characteristic acquired in the process of the voltage adjustment (step 108*c*). In this way, accuracy of "toner end" is improved.

Example 5

Example 5 is the case wherein the acquired data are such as shown by (3), i.e., less than the target characteristic (1), the development bias voltage is set to the same bias voltage as the latest successful toner concentration adjustment operation, and the greatest toner consumption amount (corresponding to toner concentration when the sensor output voltage shown in FIG. 5 is 0 V) is used for calculating disposed toner recovery amount.

Figure 10:
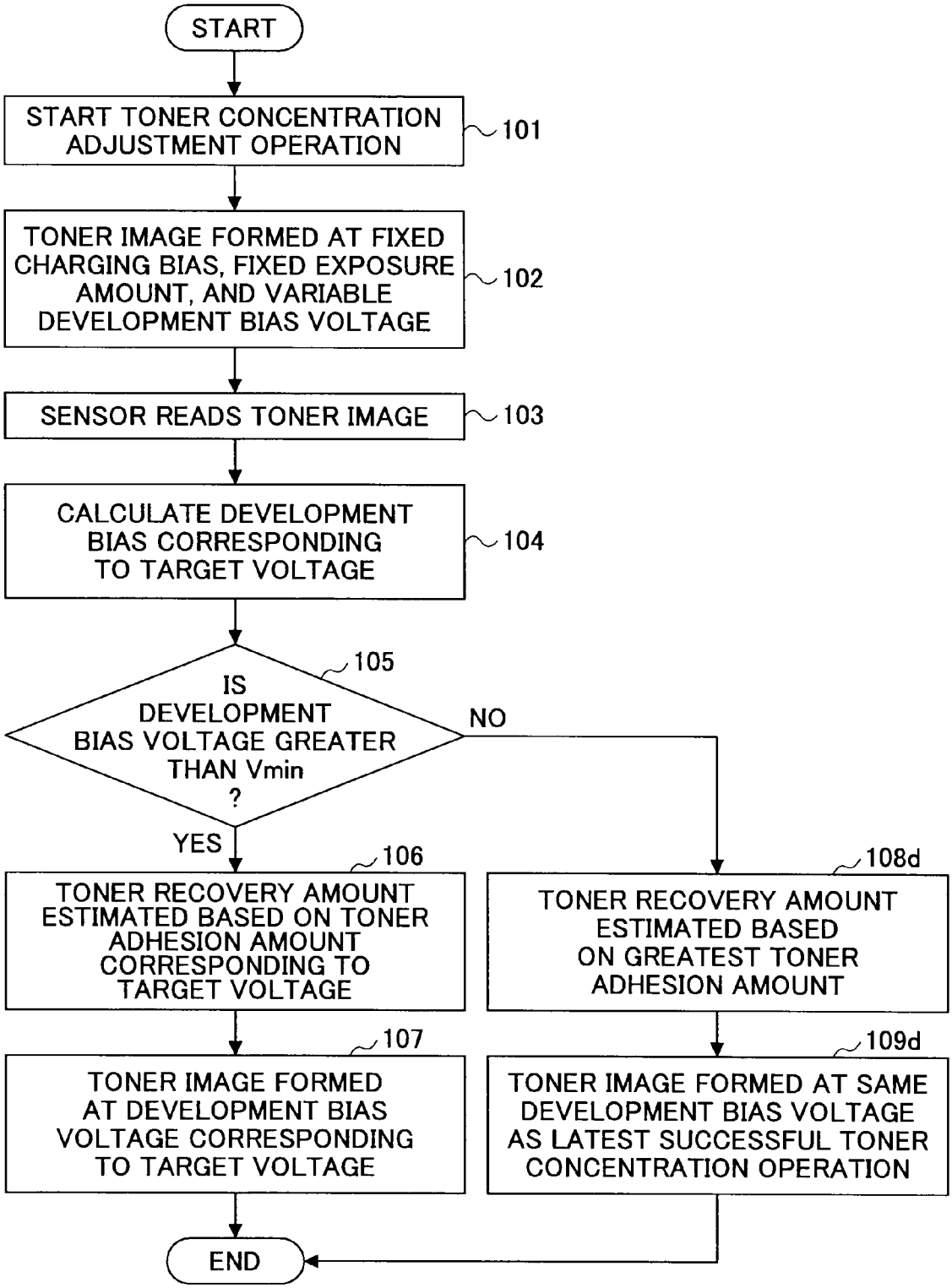
FIG. 10 is a flowchart showing operations sequence according to Example 5.

FIG. 10 is a flowchart of operations according to Example 5. Here, the steps 101 through 105 are the same as Example 1; wherein at step 105, the calculated development bias voltage is compared with the smallest bias voltage Vmin.

If the calculated development bias voltage is equal to or greater than the smallest bias voltage Vmin, the calculated development bias voltage is considered normal, toner consumption is estimated based on the amount of toner adhesion corresponding to the target voltage (step 106), and a toner image is formed at the development bias voltage corresponding to the target voltage (step 107). Otherwise, toner recovery amount is estimated based on the maximum toner adhesion amount (step 108*d*), and a toner image is formed at the same development bias voltage as the latest successful toner concentration adjustment operation (step 109*d*).

As described, according to Example 5, if it is determined through the voltage adjustment of the development unit that the toner consumption amount is greater than the predetermined toner consumption amount (No at step 105*a*), the toner recovery amount is estimated based on an amount greater than normal. Here, the toner recovery amount is that of the toner box of the toner cartridge and the toner box of the image formation apparatus as a whole (step 108*d*). In this way, disposed toner is prevented from overflowing in excess of the capacity of the disposed toner box to damage the image formation apparatus before an "end" is detected by the disposed toner box.

Example 6

Example 6 is the case wherein the acquired data are such as shown by (2), i.e., greater than the target characteristic (1), the development bias voltage is made the same bias voltage at the latest successful toner concentration adjustment operation, and the smallest toner consumption amount (toner concentration corresponding to the lowest sensor output voltage out of acquired data) is used for calculating the toner recovery amount.

Figure 11:
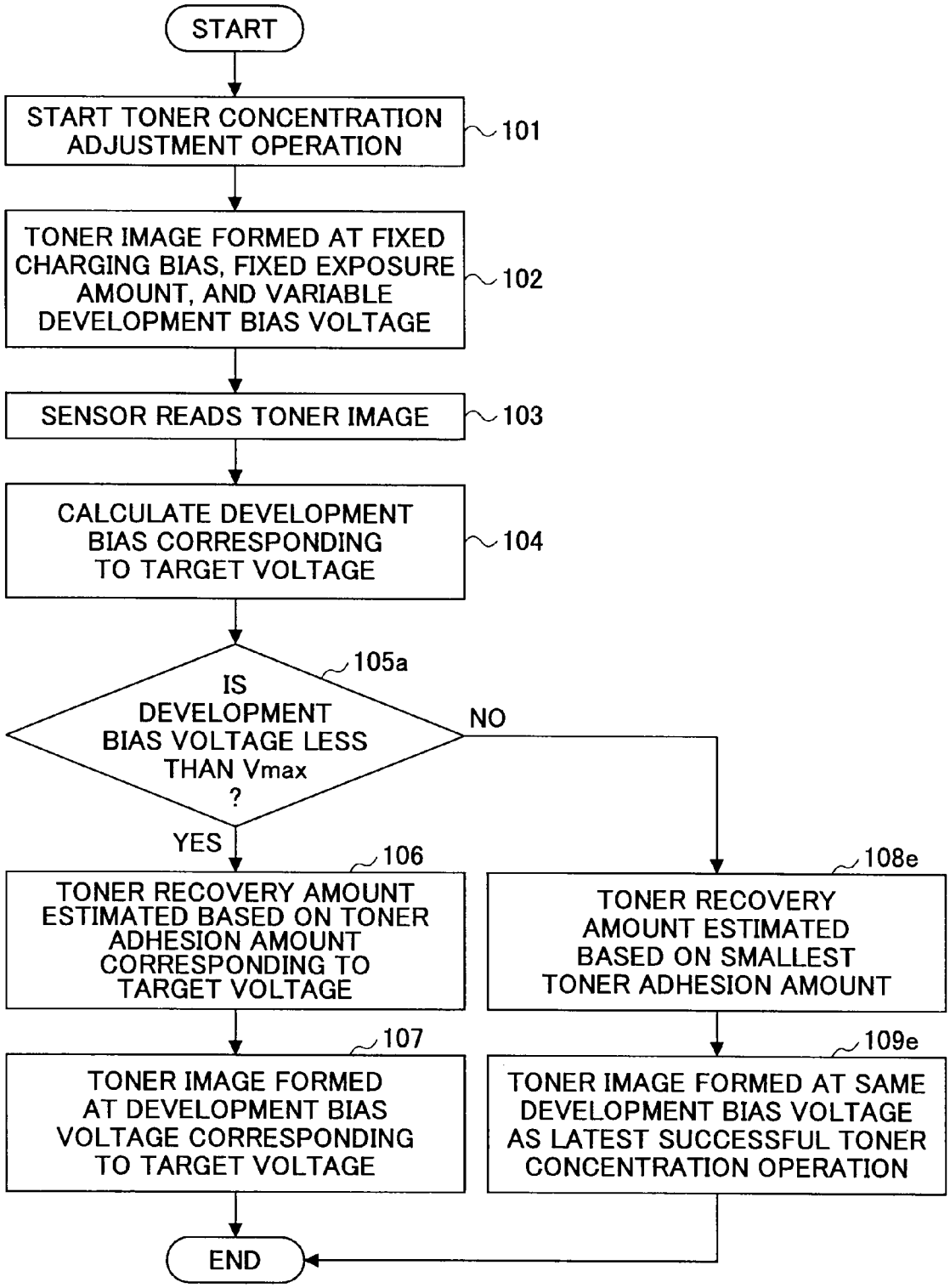
FIG. 11 is a flowchart showing operations sequence according to Example 6.

FIG. 11 is a flowchart of operations according to Example 6. Here, the steps 101 through 104 are the same as Example 1; then, at step 105*a*, the calculated development bias voltage is compared with the greatest bias voltage Vmax.

If the calculated development bias voltage is equal to or less than the greatest bias voltage Vmax, the calculated development bias voltage is considered normal, toner consumption is estimated based on the amount of toner adhesion corresponding to the target voltage (step 106), and a toner image is formed at a development bias voltage corresponding to the target voltage (step 107). If the calculated development bias voltage is greater than the greatest bias voltage Vmax, the calculated development bias voltage is considered outside of the normal range, toner consumption is estimated based on the minimum toner adhesion amount (step 108*e*), and a toner image is formed at the same bias voltage as the latest successful toner concentration adjustment operation (step 109*e*).

As described, according to Example 6, if it is determined through the voltage adjustment of the development unit that the toner consumption amount is less than the predetermined toner consumption amount (No at step 105*a*), the toner recovery amount is estimated based on an amount smaller than normal (step 108*e*). Here, the toner recovery amount is that of the toner box of the toner cartridge and the toner box of the image formation apparatus as a whole. In this way, the "end" of the disposed toner box is prevented from being displayed when there is room to accommodate disposed toner.

Example 7

Example 7 is the case wherein the acquired data are such as shown by (3), i.e., smaller than the target characteristic (1), the development bias voltage is set at the smallest bias voltage Vmin, and a toner consumption amount corresponding to the smallest bias voltage Vmin is used for calculating the toner recovery amount.

Figure 12:
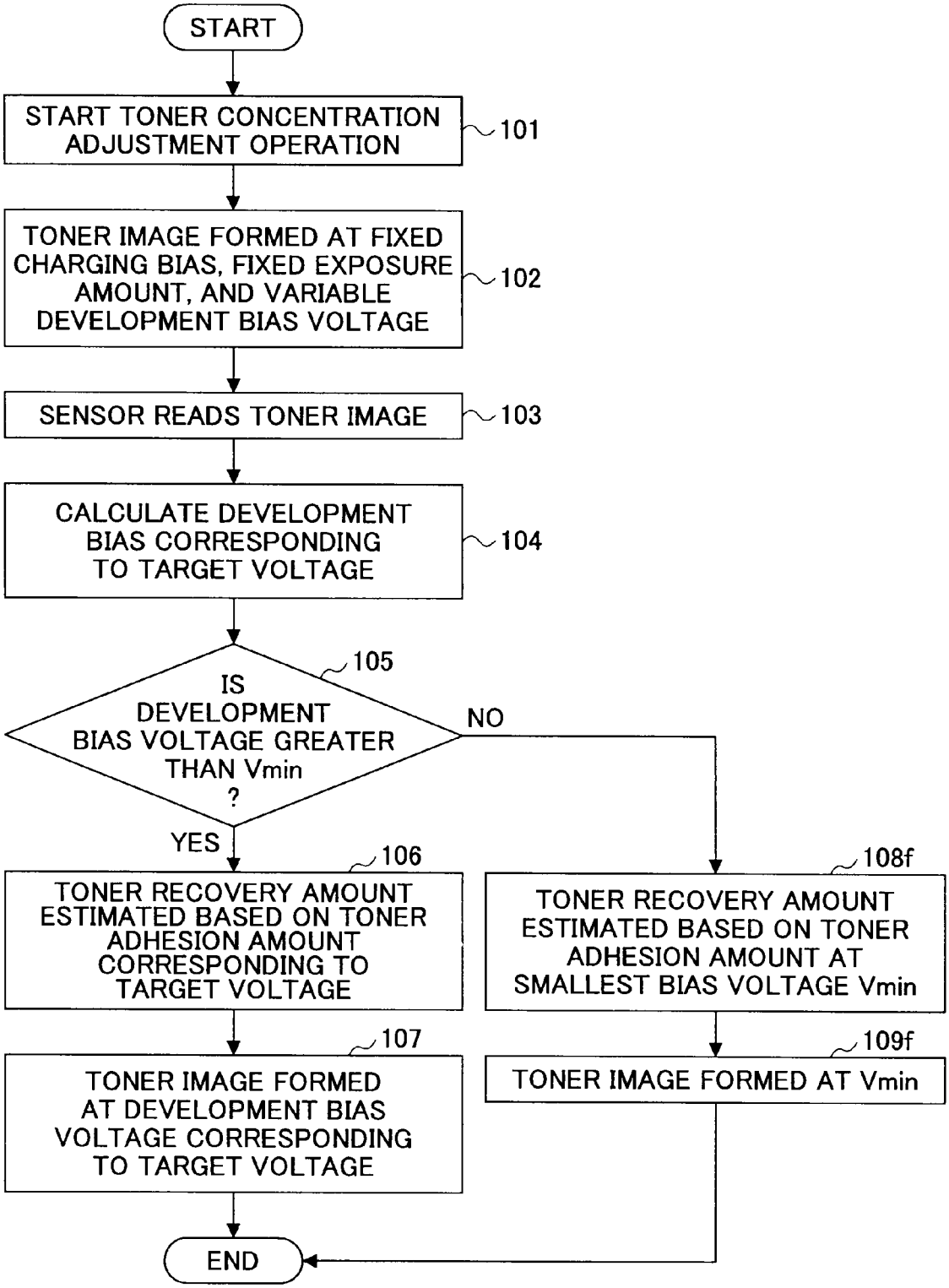
FIG. 12 is a flowchart showing operations sequence according to Example 7.

FIG. 12 is a flowchart of operations according to Example 7. Here, the steps 101 through 105 are the same as Example 1; wherein at step 105, the calculated development bias voltage is compared with the smallest bias voltage Vmin.

If the calculated development bias voltage is equal to or greater than the smallest bias voltage Vmin, the calculated development bias voltage is considered normal, toner consumption is estimated based on the amount of toner adhesion corresponding to the target voltage (step 106), and a toner image is formed at the development bias voltage corresponding to the target voltage (step 107). Otherwise, toner recovery amount is estimated based on the toner adhesion amount corresponding to the smallest bias voltage Vmin (step 108*f*), and a toner image is formed at the smallest bias voltage Vmin (step 109*f*).

As described, according to Example 7, if it is determined through the voltage adjustment of the development unit that the toner consumption amount is greater than the predetermined toner consumption amount (No at step 105*a*), the toner recovery amount is estimated considering the toner adhesion characteristic acquired in the process of the voltage adjustment (step 108*f*). In this way, accuracy of detecting the "end" of the disposed toner box is improved.

Example 8

Example 8 is the case wherein the acquired data are such as shown by (2), i.e., greater than the target characteristic (1), the development bias voltage is set at the greatest bias voltage Vmax, and a toner consumption amount corresponding to the greatest bias voltage Vmax is used for calculating the toner recovery amount.

Figure 13:
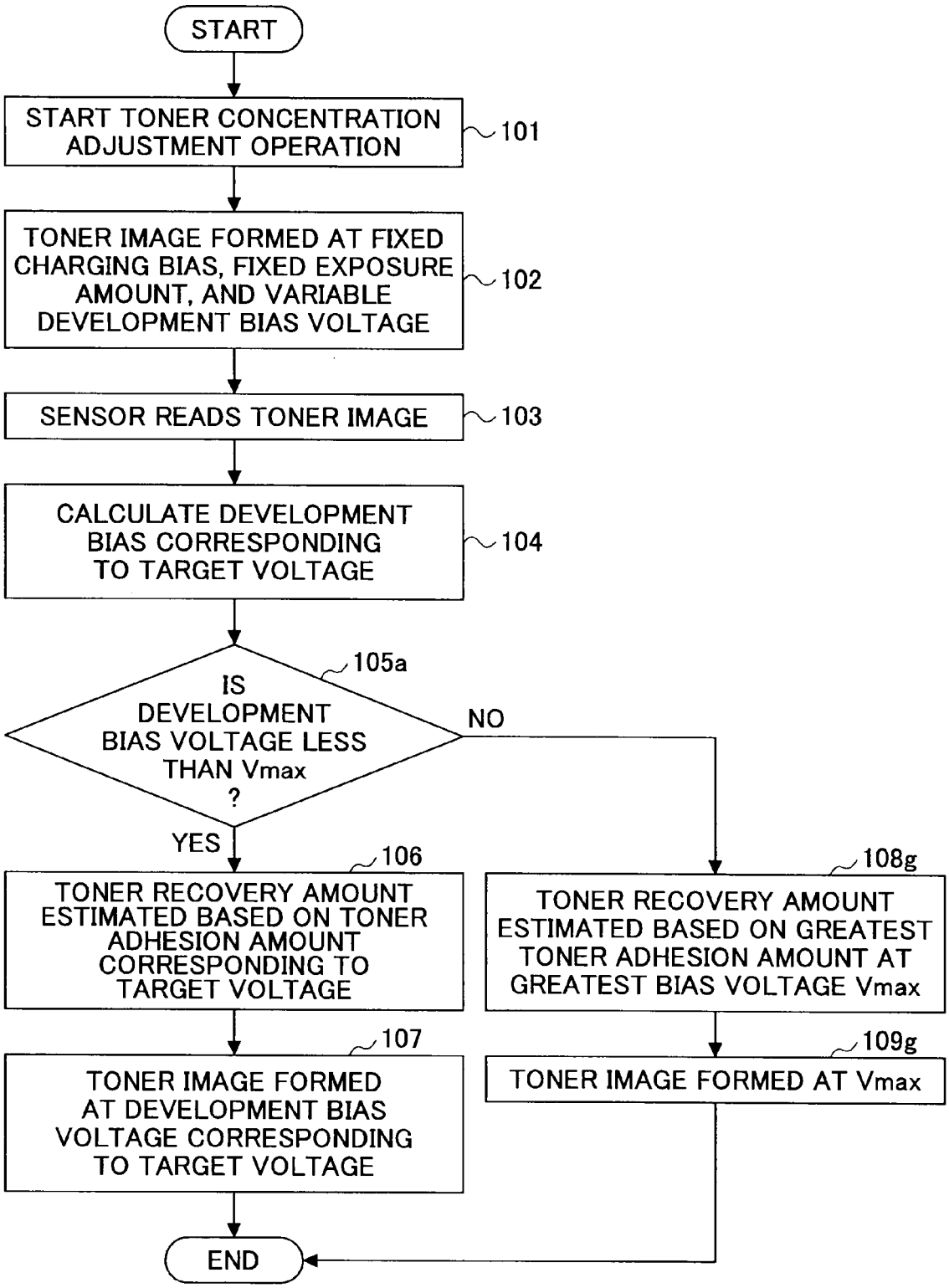
FIG. 13 is a flowchart showing operations sequence according to Example 8.

FIG. 13 is a flowchart of operations according to Example 6. Here, the steps 101 through 104 are the same as Example 1; then, at step 105*a*, the calculated development bias voltage is compared with the greatest bias voltage Vmax.

If the calculated development bias voltage is equal to or less than the greatest bias voltage Vmax, the calculated development bias voltage is considered normal, toner consumption is estimated based on the amount of toner adhesion corresponding to the target voltage (step 106), and a toner image is formed at a development bias voltage corresponding to the target voltage (step 107). If the calculated development bias voltage is greater than the greatest bias voltage Vmax, the calculated development bias voltage is considered outside of the normal range, toner recovery amount is estimated based on a toner adhesion amount corresponding to the greatest bias voltage Vmax (step 108*g*), and a toner image is formed at the greatest bias voltage Vmax (step 109*g*).

As described, according to Example 8, if it is determined through the voltage adjustment of the development unit that the toner consumption amount is less than the predetermined toner consumption amount (No at step 105*a*), the toner recovery amount is estimated considering the toner adhesion characteristic acquired in the process of the voltage adjustment (step 108*g*). In this way, accuracy of detecting the "end" status is improved.

Further, the process of the Examples described above is programmed such that the program may be performed by a computer. Further, the computer-executable program is stored in a computer-readable recording medium such as a FD, a CD-ROM disk, and a memory card, or alternatively, the computer-executable program may be distributed through a network. The computer-executable program is installed, e.g., in a HDD of the control unit 18.

In addition, although the Embodiments are described about the image formation apparatus capable of forming a multicolor image with the four photoconductors 1-*a*, 1-*b*, 1-*c*, and 1-*d*, the present invention is also applicable to the cases wherein an image is formed in a single color using four photoconductors 1-*a*, 1-*b*, 1-*c*, and 1-*d*, and wherein toner concentration of a toner image formed on a photoconductor surface is detected. In addition, a toner image is the so-called toner concentration detection pattern, and is prepared for every color. Therefore, the control described above is performed for every color.

Further, the present invention is not limited to these embodiments, but variations and modifications may be made without departing from the scope of the present invention.

The present application is based on Japanese Priority Application No. 2007-071371 filed on Mar. 19, 2007 with the Japanese Patent Office, the entire contents of which are hereby incorporated by reference.

What is claimed is:

1. An image formation apparatus, comprising:

a toner cartridge for holding toner;

an image supporting unit, on which an electrostatic latent image corresponding to a toner image is formed;

a toner development unit for developing the latent image into the toner image with the toner;

a detecting unit for detecting toner concentration of the toner image; and a control unit for controlling an amount of toner adhering to the latent image by adjusting a development bias voltage based on an output of the detecting unit; wherein if control carried out by the control unit based on the detection output of the detecting unit is insufficient, and consumption of the toner is out of a predetermined normal range, the control is carried out by estimating one of toner consumption amount and toner recovery amount in a direction that departs from the predetermined normal range.

2. The image formation apparatus as claimed in claim 1, wherein only one image supporting unit is provided, and the detecting unit detects the toner concentration of the toner image in a single color.

3. The image formation apparatus as claimed in claim 1, wherein a plurality of the image supporting units is provided, and the detecting unit detects the concentration of the toner image in a plurality of colors, wherein the toner image is transferred to a middle transfer medium from the image supporting units.

4. The image formation apparatus as claimed in claim 1, wherein if the toner consumption amount is greater than the predetermined normal range, the control unit controls by increasing the estimated toner consumption amount.

5. The image formation apparatus as claimed in claim 1, wherein if the toner consumption amount is less than the predetermined normal range, the control unit controls by decreasing the estimated toner consumption amount.

6. The image formation apparatus as claimed in claim 1, wherein if the toner consumption amount is greater than the predetermined normal range, the control unit controls by increasing the estimated toner consumption amount considering a difference from the predetermined normal range.

7. The image formation apparatus as claimed in claim 1, wherein if the toner consumption amount is less than the predetermined normal range, the control unit controls by decreasing the estimated toner consumption amount considering a difference from the predetermined normal range.

8. The image formation apparatus as claimed in claim 1, wherein if the toner consumption amount is greater than the predetermined normal range, the control unit controls by increasing estimates of the toner recovery amount in the toner cartridge and a disposed toner amount of the image formation apparatus as a whole.

9. The image formation apparatus as claimed in claim 1, wherein if the toner consumption amount is less than the predetermined normal range, the control unit controls by decreasing estimates of the toner recovery amount in the toner cartridge and a disposed toner amount of the image formation apparatus as a whole.

10. The image formation apparatus as claimed in claim 1, wherein if the toner consumption amount is greater than the predetermined normal range, the control unit controls by increasing estimates of the toner recovery amount in the toner cartridge and a disposed toner amount of the image formation apparatus as a whole considering a difference from the predetermined normal range.

11. The image formation apparatus as claimed in claim 1, wherein if the toner consumption amount is less than the predetermined normal range, the control unit controls by decreasing estimates of the toner recovery amount in the toner cartridge and a disposed toner amount of the image formation apparatus as a whole considering a difference from the predetermined normal range.

12. A control method of an image formation apparatus that includes a toner cartridge for holding toner, an image supporting unit, on which an electrostatic latent image corresponding to a toner image is formed, a toner development unit for developing the latent image into the toner image with the toner, a detecting unit for detecting toner concentration of the toner image, and a control unit for controlling an amount of toner adhering to the latent image;

the control method comprising:

a step of detecting the toner concentration of the toner image; and a step of adjusting a development bias voltage based on an output of the detecting unit; wherein if control by the control unit based on the detection output of the detecting unit is insufficient, and consumption of the toner is out of a predetermined normal range, the control is carried out by estimating one of toner consumption amount and toner recovery amount in a direction that departs from the predetermined normal range.

13. A computer-readable recording medium for storing a computer-executable program for a computer to realize the control method of the image formation apparatus as claimed in claim 12.

* * * * *